US008485376B2

(12) United States Patent
Samprathi

(10) Patent No.: US 8,485,376 B2
(45) Date of Patent: Jul. 16, 2013

(54) FOLDING CONTAINER

(75) Inventor: Venu Samprathi, Palatine, IL (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 13/592,925

(22) Filed: Aug. 23, 2012

(65) Prior Publication Data

US 2013/0001225 A1 Jan. 3, 2013

Related U.S. Application Data

(63) Continuation of application No. 12/939,554, filed on Nov. 4, 2010, now Pat. No. 8,267,270, which is a continuation of application No. 12/114,192, filed on May 2, 2008, now Pat. No. 7,861,879.

(51) Int. Cl.
*B65D 6/00* (2006.01)
*B65D 8/14* (2006.01)

(52) U.S. Cl.
USPC ..... 220/7; 220/6

(58) Field of Classification Search
USPC ..... 220/6, 7, 4.28; 206/600
See application file for complete search history.

(56) References Cited

U.S. PATENT DOCUMENTS

| | | | | |
|---|---|---|---|---|
| 3,870,185 | A | 3/1975 | Sanders et al. | |
| 4,798,304 | A * | 1/1989 | Rader | 220/6 |
| D381,513 | S | 7/1997 | Brauner | |
| 5,673,791 | A | 10/1997 | Jamison | |
| 5,975,324 | A | 11/1999 | Schmitt | |
| 6,015,056 | A | 1/2000 | Overholt et al. | |
| 6,029,840 | A | 2/2000 | Brauner | |
| 6,209,742 | B1 | 4/2001 | Overholt et al. | |
| 6,293,417 | B1 | 9/2001 | Varfeldt | |
| 6,293,418 | B1 | 9/2001 | Ogden et al. | |
| D452,614 | S | 1/2002 | Overholt | |
| 6,386,388 | B1 | 5/2002 | Overholt | |
| 6,398,054 | B1 | 6/2002 | Overholt et al. | |
| 6,405,888 | B1 | 6/2002 | Overholt et al. | |
| 6,446,825 | B1 | 9/2002 | Godoy | |
| 6,460,717 | B1 | 10/2002 | Smyers et al. | |
| 6,601,724 | B1 | 8/2003 | Koefelda et al. | |
| 6,631,822 | B1 | 10/2003 | Overholt | |
| 6,669,044 | B2 | 12/2003 | Murakami et al. | |
| 6,820,761 | B1 | 11/2004 | Mouri et al. | |
| 6,863,180 | B2 | 3/2005 | Apps et al. | |
| 6,868,979 | B2 | 3/2005 | Rader | |
| 6,899,242 | B2 | 5/2005 | Overholt et al. | |
| 6,918,502 | B1 | 7/2005 | Overholt et al. | |
| 7,011,225 | B2 | 3/2006 | Oster et al. | |
| 7,017,765 | B2 | 3/2006 | Overholt | |
| 7,017,766 | B2 | 3/2006 | Hsu et al. | |

(Continued)

FOREIGN PATENT DOCUMENTS

| | | |
|---|---|---|
| CA | 2665281 A1 | 11/2009 |
| EP | 1418130 | 5/2004 |

(Continued)

*Primary Examiner* — Harry Grosso
(74) *Attorney, Agent, or Firm* — Ungaretti & Harris LLP

(57) ABSTRACT

A folding container including a base portion, first and second lower side wall portions, and first and second upper side wall portions having a hinge connection to the lower side wall portions. The folding container including locking tabs in the base portion for engaging notches in the lower side wall portions when the container is in a folded configuration.

23 Claims, 16 Drawing Sheets

U.S. PATENT DOCUMENTS

| | | | |
|---|---|---|---|
| 7,032,765 | B2 | 4/2006 | Miller et al. |
| 7,044,319 | B2 | 5/2006 | Overholt et al. |
| 7,048,135 | B2 | 5/2006 | Smyers et al. |
| 7,059,489 | B2 | 6/2006 | Apps et al. |
| 7,063,223 | B2 | 6/2006 | Iwahara et al. |
| 7,100,786 | B2 | 9/2006 | Smyers |
| 7,104,414 | B2 | 9/2006 | Apps et al. |
| 7,128,231 | B2 | 10/2006 | Overholt |
| 7,159,730 | B2 | 1/2007 | Rumpel |
| 7,195,127 | B2 | 3/2007 | Hsu et al. |
| 7,264,122 | B2 | 9/2007 | Koefelda et al. |
| 7,357,269 | B2 | 4/2008 | Apps |
| 7,370,771 | B2 | 5/2008 | Rader |
| 7,861,879 | B2 | 1/2011 | Samprathi |
| 8,267,270 | B2 | 9/2012 | Samprathi |
| 2004/0084447 | A1 | 5/2004 | Dubois |
| 2005/0098556 | A1 | 5/2005 | Kellerer |
| 2006/0011627 | A1 | 1/2006 | Overholt et al. |
| 2006/0231555 | A1 | 10/2006 | Smyers et al. |
| 2006/0237456 | A1 | 10/2006 | McDade |
| 2007/0095692 | A1 | 5/2007 | Apps |
| 2007/0095842 | A1 | 5/2007 | Apps |
| 2007/0194023 | A1 | 8/2007 | Apps et al. |
| 2007/0272579 | A1 | 11/2007 | Cavalcante |
| 2007/0278223 | A1 | 12/2007 | Ficker |
| 2008/0116201 | A1 | 5/2008 | Baltz |

FOREIGN PATENT DOCUMENTS

| | | | |
|---|---|---|---|
| EP | 1472147 | | 11/2004 |
| EP | 1935792 | | 6/2008 |
| GB | 2415689 | | 1/2006 |
| GB | 2425303 | | 10/2006 |
| GB | 2431921 | | 5/2007 |
| GB | 2431922 | | 5/2007 |
| GB | 2438506 | | 11/2007 |
| GB | 2443949 | | 5/2008 |
| WO | 03059763 | | 7/2003 |
| WO | 03078259 | | 9/2003 |
| WO | 03101846 | | 12/2003 |
| WO | 2004033311 | A2 | 4/2004 |
| WO | 2004080830 | A1 | 9/2004 |
| WO | 2004085779 | A2 | 10/2004 |
| WO | 2004094250 | A1 | 11/2004 |
| WO | 2004101376 | A1 | 11/2004 |

* cited by examiner

FOLDING CONTAINER

CROSS-REFERENCE TO RELATED APPLICATIONS

This application is a continuation of U.S. patent application Ser. No. 12/939,554 filed Nov. 4, 2010 now U.S. Pat. No. 8,267,270, which is a continuation of U.S. patent application Ser. No. 12/114,192 filed May 2, 2008 now U.S. Pat. No. 7,861,879.

FEDERALLY SPONSORED RESEARCH OR DEVELOPMENT

Not Applicable.

TECHNICAL FIELD

The invention generally relates to a foldable container having integrally molded hinges, and more particularly to a pin-less foldable container having components that are snap-fitted together to provide a secure structure for withstanding internal and external pressures.

BACKGROUND OF THE INVENTION

Foldable or collapsible containers are useful in transporting and/or storing a variety of items or goods. In particular, such containers can be used to transport automotive (or other similar) parts.

Foldable containers take up less volume in a collapsed state. Accordingly, such containers can be more efficiently transported when empty. However, because the containers are collapsible, it is important that they are structurally sound during transportation, both in the unfolded, load carrying configuration, as well as in the collapsed or folded configuration.

In order to be foldable, the containers are formed to have a number of moving parts, such as side walls and end walls that collapse inwardly. To accomplish this, hinge elements are incorporated into the container. Such hinge elements have typically required one or more pins be inserted into the element to act as an axle.

In some known containers, certain of the hinge elements can be formed without a pin by creating axle nubs (e.g., partial cylindrical extensions) that extend from projections from one component of the container, that mate with a corresponding enclosure on another component. However, these are typically not as strong as having a complete axle extend throughout the hinge element, and are prone to easily disengage during use.

A number of considerations are involved in designing and creating such foldable containers. These include cost of construction, number of parts, time and manpower required to assemble, time and manpower to fix or replace parts, cost of materials, strength, stability, etc.

The present invention is provided to solve the problems discussed and to provide advantages and aspects not provided by prior folding containers of this type. A full discussion of the features and advantages of the present invention is deferred to the following detailed description, which proceeds with reference to the accompanying drawings.

SUMMARY OF THE INVENTION

The present invention provides a foldable container that can be quickly and easily assembled. The container is constructed from components that are snap fitted together without requiring the insertion of separate pins into hinge structures on the container. The container also includes structures to provide strength and stability in both a folded and unfolded configuration.

According to one aspect of the invention, a pin-less folding container is provided. The container includes a generally rectangular base portion having a top or upper surface for supporting goods. The base portion includes a first side and an opposing second side, a first end and an opposing second end. A plurality of hook-shaped snap elements are integrally formed with and extend upward from the top surface of the base portion along the first side and a plurality of hook-shaped snap elements are integrally formed with and extend upward from the top surface of the base portion along the second side. A short ledge extends upward about a periphery of the top surface.

The foldable container also includes a generally rectangular rim portion having a first side, an opposing second side, a first end and an opposing second end collectively defining a central rectangular opening. The rim portion includes a plurality of integrally formed hook-shaped snap elements extending downward from the first side of the rim portion and a plurality of integrally formed hook-shaped snap elements extending downward from the second side of the rim portion.

The foldable container additionally includes a first side wall connected to the first side of the base portion and the first side of the rim. The first side wall includes a first lower side wall portion. The first lower side wall portion includes a plurality of integrally formed hinge axles in a bottom of the first lower side wall portion. Each hinge axle is formed as cylindrical bar extending between a first wall of a square or rectangular gap in the bottom of the lower side wall portion, and a second wall of the gap, and is positioned in one of the plurality of hook-shaped snap elements along the first side of the base portion to form a rotational hinge connection between the first lower side wall portion and the first side of the base portion. The first lower side wall portion also includes an integrally formed top hinge element (e.g., either one or more axles or hook shaped projections) on a top of the first lower side wall portion for engagement with a corresponding hinge element.

The first side wall also includes a first upper side wall portion. The first upper side wall portion has an integrally formed bottom hinge element rotationally connected to the top hinge element of the first lower side wall portion (e.g., either one or more axles or hook shaped projections to correspond to the axles or hook shaped projections of the lower side wall portion). Additionally, the first upper side wall portion includes a plurality of integrally formed hinge axles. Each hinge axle is formed as cylindrical bar extending between a first wall of a gap in the upper side wall portion and a second wall of the gap and is positioned in one of the plurality of hook-shaped elements along the first side of the rim portion.

The container also includes a second side wall having a second lower side wall portion and a second upper side wall portion similar to that of the first side wall. The second side wall is connected to the second side of the base portion and the rim portion.

The rim portion can also include a plurality of integrally formed hook-shaped snap elements extending downward from each of the first and second ends of the rim portion. A first end wall having a plurality of integrally formed hinge axles along a top of the first end wall can be rotationally connected to the first end of the rim portion. Each hinge axle is formed as cylindrical bar extending between a first wall of a gap in the first end wall and a second wall of the gap and is positioned in one of the plurality of hook-shaped elements on the first end of the rim portion. Similarly, the rim portion can include a second end wall having a plurality of integrally formed hinge axles along a top of the second end wall. Again, each hinge axle is formed as cylindrical bar extending between a first wall of a gap in the second end wall and a second wall of the gap and is positioned in one of the plurality of hook-shaped elements on the second end.

To facilitate assembly of the container and maintain the side walls in proper position, the container can further include a plurality of ribs having a curved upper surface for engaging a portion of the bottom of the lower side wall portion extending along the first side and second side of the base portion. Similarly, the container can include a plurality of ribs having a curved upper surface for engaging a portion of the top of the upper side wall portion extending along the first side and second side of the rim portion.

The hook-shaped snap elements can be uniquely configured to facilitate snapping the side wall portion or end wall into place. In this regard, each hook-shaped element can include a first flat ramp segment inclined at a first angle with respect to the vertical, and configured to guide a corresponding hinge axle (initially moving along or engaging the otherwise curved exterior surface of the hook portion of the element) to snap the hinge axle into position in the interior of the hook-shaped snap element.

Additionally, each hook-shaped snap element can include a second flat ramp segment positioned between the first flat ramp segment and an end of the hook portion. The second flat ramp segment can be inclined at a second angle greater than the first angle, and configured to further facilitate and guide a corresponding hinge axle to snap the hinge axle into position in the hook-shaped snap element.

The base portion of the container can include a first side wall locking tab extending upward from the top surface of the base portion, and a second side wall locking tab extending upward from the top surface of the base portion. The first lower side wall portion includes a notch for engaging the first locking tab when the container is in a folded configuration, and the second lower side wall portion includes a notch for engaging the second locking tab when the container is in a folded configuration. The tabs and notches prevent the side walls from moving during transportation in a folded configuration.

In accordance with another embodiment of the present invention, a container having components with integrally formed hinge elements is provided. The container includes a rectangular base having a plurality of integrally formed upwardly extending snap-hooks along a first side of the base, and a plurality of integrally formed upwardly extending snap-hooks along a second side of the base. The snap-hooks have a hook shaped portion including a first flattened ramp segment along an exterior of the hook shaped portion. The container further includes a first side wall connected to the first side of the base having a plurality of integrally formed hinge axles extending between a corresponding plurality of gaps in the bottom of the first side wall portion and, a second side wall connected to the second side of the base having a plurality of integrally formed hinge axles extending between a corresponding plurality of gaps in the bottom of the second side wall portion The snap-hooks can further include a second flattened ramp segment along the exterior of the hook shaped portion between the first flattened ramp segment and an end of the hook shaped portion. The second flattened ramp segment is inclined inward at a second angle greater than the first angle.

Additionally, the container can include a generally rectangular rim portion having a plurality of snap-hooks extending downward along a first side and a second side of the rim portion. The snap-hooks are rotationally connected to a top of the first side wall and the second side wall.

In accordance with another aspect of the invention, a foldable container having support structure in the side walls is provided. The container comprises a base having a first side and a second side, and a rim having a first side and a second side. The container includes a first side wall having a lower side wall portion having a bottom connected to the first side of the base and an upper side wall portion having a top connected to the first side of the rim. The lower side wall portion also includes a top having a hinge connection to a bottom of the upper side wall portion. Additionally, a first blade extends upward from the top of the lower side wall portion. The first blade cooperates with a first pocket extending downward from the bottom of the upper side wall portion for receiving the blade.

The container also includes a second side wall having a lower side wall portion having a bottom connected to the second side of the base and an upper side wall portion having a top connected to the second side of the rim. The lower side wall portion also includes a top having a hinge connection to a bottom of the upper side wall portion. Similar to the first side wall, the lower portion of the second side wall includes a second blade extending upward from the top of the lower side wall portion and the upper side wall portion includes a second pocket extending downward from the bottom of the upper side wall portion for receiving the blade. Preferably, the blade and pocket in both side walls are located proximate a mid portion of the upper and the lower side wall portions.

The first blade is sized to contact a top surface of the first pocket. The first pocket includes a generally rectangular bottom surface defining an opening of the pocket and is sized so that the bottom surface rests on the top of the lower side wall portion.

In accordance with another aspect of the invention, a foldable container includes a base having a first side and a second side, and a rim having a first side and a second side. The container also includes a first side wall having a lower side wall portion having a bottom connected to the base and an upper side wall portion having a top connected to the rim. The lower side wall portion includes a top having a hinge connection to a bottom of the upper side wall portion. A first blade extends downward from the bottom of the upper side wall portion and a first pocket extends upward from the top of the lower side wall portion for receiving the blade.

In yet another aspect of the invention, a folding container comprises a base having a first side and a second side, and a rim having a first side and a second side, and a first side wall having a lower side wall portion having a bottom connected to the base and an upper side wall portion having a top connected to the rim. The lower side wall portion includes a top having a hinge connection to a bottom of the upper side wall portion. Additionally, the container includes a first L-shaped support extending downward from the bottom of the upper side wall portion and, a first open pocket proximate the top of the lower side wall portion configured to receive the first L-shaped support.

The container can also include a second L-shaped support extending downward from the bottom of the upper wall portion where the second L-shaped support is spaced apart from the first L-shaped support, and a second open pocket proximate a top of the lower side wall portion configured to receive the second L-shaped support. A blade and pocket combination can be positioned between the L-shaped pockets.

The first L-shaped support can include a generally planar first wall parallel to the upper side wall portion and a horizontal wall extending from a bottom end of the L-shaped support. The first open pocket can include a horizontal landing for contacting the horizontal wall of the first L-shaped support.

In accordance with yet another aspect of the invention, a folding container comprises a base having a first side and a second side, and a rim having a first side and a second side, and a first side wall having a lower side wall portion having a bottom connected to the base and an upper side wall portion having a top connected to the rim where the lower side wall portion including a top having a hinge connection to a bottom of the upper side wall portion. A first L-shaped support extends upward from the top of the lower side wall portion, and a first open pocket proximate the bottom of the upper side wall portion is configured to receive the first L-shaped support.

In accordance with a further aspect of the invention, a folding container having a plurality of upper support stanchions is provided. The container comprises a generally rectangular base having a first side, a second side, a first end and a second end, a first side wall having a bottom connected to the first side of the base by a hinge, and a second side wall having a bottom connected to the second side of the base by a hinge. The container also includes a generally rectangular rim having a first side, a second side, a first end and a second end collectively defining a central opening. The first side of the rim is connected to a top of the first side wall by a hinge and the second side of the rim connected to a top of the second side wall by a hinge. A plurality of stanchions, such as T-shaped (in cross-section) ribs extend upward from a generally horizontal top wall of the rim. The rim can comprise an outer wall, an inner wall, and a horizontal top surface between the outer wall and the inner wall. The stanchions could then extend upward from the horizontal top surface.

Preferably, at least one of the plurality of stanchions is positioned proximate each corner of the rim. Additionally, at least one of the plurality of stanchions is positioned approximate a mid portion of the first side and at least one of the plurality of stanchions is positioned approximate a mid portion of the second side.

In accordance with one embodiment of the container, the outer wall of the rim includes a first raised portion proximate the first corner, a second raised portion proximate the second corner, a third raised portion proximate the third corner, and a fourth raised portion proximate the fourth corner. Similarly, the outer wall includes a fifth raised portion proximate mid portion of the first side, and a sixth raised portion proximate the mid portion of the second side.

In accordance with yet another aspect of the invention, a folding container is provided having a visual mechanism for confirming the container is locked in an unfolded configuration. The folding container comprises a generally rectangular base having a first side, an opposing second side, a first end and an opposing second end. A first wall or projection extends upward along the first end of the base and a second projection extending upward along the second end of the base. The first and second projections can be part of a continuous wall or projection extending about the entire periphery of the base. The container further includes a first side wall connected to the first side of the base and a second side wall connected to the second side of the base. A generally rectangular rim is provided having a first side, an opposing second side, a first end and an opposing second end defining an opening there between. The first side of the rim is connected to the first side wall and the second side of the rim is connected to the second side wall.

The container includes a first end wall having a top end rotationally connected to the first end of the rim by a first hinge. The first end wall has a first snap element extending from a bottom end of the end wall. Similarly, a second end wall is rotationally connected to the second end of the rim by a second hinge. A first locking tab extends from the first ledge of the base for engaging the first snap element of the first end wall. The first locking tab includes an opening where the first snap element is at least partially visible when the first end wall is locked to the base in an unfolded configuration. A second locking tab can extend from the second ledge of the base for engaging a second snap element extending from a bottom of the second end wall. The second locking tab also includes an opening where the second snap element is at least partially visible when the second end wall is locked to the base in an unfolded configuration.

Preferably, the first and second snap elements include an upwardly projecting ridge. The upwardly projecting ridge is configured to fit in the window of the locking tab when the first and second walls are locked in place. The first and second snap elements also include an inclined surface for contacting an outer portion of the locking tab and forcing the snap element downward until it snaps into place in the locking tab.

To facilitate a visual inspection, the first snap element (or at least the portion viewable through the window, e.g., the upwardly projecting ridge) is a first color or design and the first locking tab is a second color or design different from the first color or design. Contrasting colors or designs will make it easy to determine whether the snap element is in place.

The locking tabs extend from the respective projections toward the interior of the container. While some containers may only use one locking tab for each end wall, additional tabs and snap elements can be employed as desired depending on the size and strength considerations at issue.

The end wall can be configured to include structure for supporting any load applied through the locking tabs. This will reduce fatigue of the snap element. The structure includes a first support that extends from the bottom of the first end wall proximate a first side of the snap element and is positioned to receive loads applied by or through the locking tab. Similarly, a second support extends from the bottom of the first end wall proximate a second side of the snap element and is also positioned to receive loads applied by the locking tab. This structure can be utilized regardless of whether more than one color is used.

In accordance with another aspect of the container a folding container configured for hot stamping after assembly is provided. The folding container comprises a base having a first side and a second side, a first side wall having a lower side wall portion connected at a bottom to the first side of the base by a hinge, and an upper side wall portion connected at a bottom to a top of the lower side wall by a hinge. The container also includes a second side wall having a lower side wall portion connected at a bottom to the second side of the base by a hinge, and an upper side wall portion connected at a bottom to a top of the lower side wall by a hinge. The folding container further includes a rim having a first side connected by a hinge to a top of the upper side wall portion of the first side and a second side connected by a hinge to a top of the upper side wall portion of the second side wall. The rim includes a first tab on the first side extending below portions of the rim on either side of the first tab so that the first tab can be captured between a rear support and a die head of a hot stamping device when the container is in a partially folding configuration.

The rim can include a second tab on the second side of the rim extending below portions of the rim on either side of the second tab so that the second tab can be captured between a rear support and a die head of a hot stamping device when the container is in a partially folding configuration. Preferably, the tab is positioned proximate a mid portion of the first side or the second side of the rim.

In accordance with yet another aspect of the invention, a method for hot stamping an assembled foldable container is provided. The method comprises the steps of first assembling a foldable container having a base, a first foldable side wall connected to a first side of the base, a second foldable side wall connected to a second side of the base, and a rim connected to a top of the first side wall and the second side wall. The rim includes a tab extending downward past a section of the rim on a first side of the tab and a section of the rim on an opposing second side of the tab. The method further comprises partially folding the assembled container to expose a back surface of the tab. Once the tab is exposed on both sides a hot stamping process can be employed. This comprises positioning a support piece of a hot stamping device against the back surface of the tab of the assembled container, positioning a film (containing indicia and/or a design to be hot stamped to the container) on a front surface of the tab of the assembled container and contacting the film with a die head of the hot stamping device.

Other features and advantages of the invention will be apparent from the following specification taken in conjunction with the following drawings.

BRIEF DESCRIPTION OF THE DRAWINGS AND ATTACHMENTS

To understand the present invention, it will now be described by way of example, with reference to the accompanying drawings in which.

DETAILED DESCRIPTION

Figure 1:
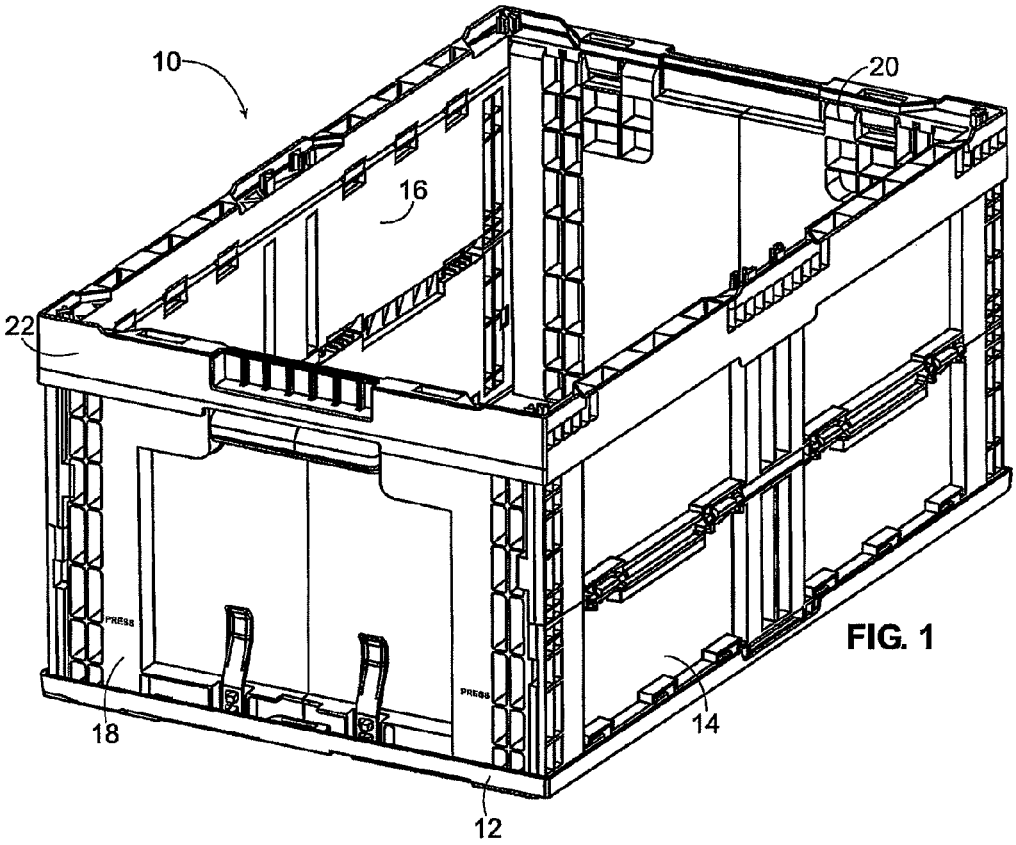
FIG. 1 is a perspective view of an embodiment of a container in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The design of the present invention includes features for improving assembly, manufacture, stability and strength of a foldable or collapsible container. Each of the components of the container can be formed in an injection molding process, or other well known processes.

Referring to FIG. 1, a foldable container 10 in accordance with the present invention is provided. The foldable container 10 includes a generally rectangular base portion 12. The base portion 12 supports a first sidewall 14 and a second sidewall 16, and a first end wall 18 and a second end wall 20. The sidewalls 14, 16 and end walls 18, 20 extend to a generally rectangular rim portion 22.

Figure 2:
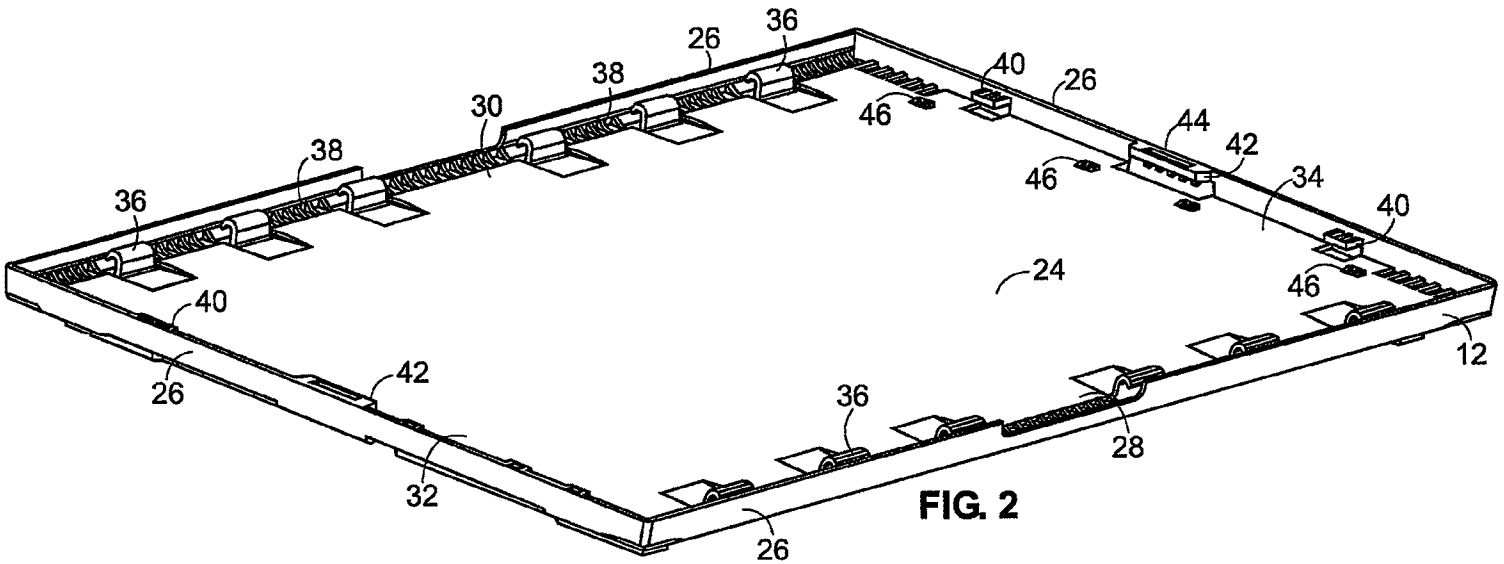
FIG. 2 is a top perspective view of a base portion of the container of FIG. 1.

The base portion 12 of the container 10 (shown in FIGS. 2-3) includes a rectangular support surface 24 surrounded by a four raised walls or projections 26 along the periphery of the support surface 24. The raised projections 26 extend along first and second sides 28, 30 of the base portion 12, and along first and second ends 32, 34.

The upper surface 24 of the base portion 12 includes a plurality of hook-shaped snap elements or simply snap-hooks 36 extending upward along each side 28, 30 of the base portion 12 proximate the projections 26. The snap-hooks 36 cooperate with hinge elements in the side walls 14, 16 in a manner described in more detail below, to connect the side walls 14, 16 to the base portion 12 and allow for rotational movement of the sidewalls 14, 16 with respect to the base portion 12. A plurality of ribbed segments 38, between the snap-hooks 36 are used to facilitate engagement of the hinge elements with the snap-hooks 36 when assembling the container, and to keep the sidewalls 14, 16 in place. The ribbed segments 38 have a curved or slanted upper surface to guide the hinge elements on the side walls into the snap-hooks 36 during assembly as described below, and hold them in place. The snap-hooks 36 and hinge elements eliminate the need for a separate hinge pin typically utilized in such containers. The elimination of the hinge pin lowers the cost of assembly by reducing the number of parts in the container and the number of steps required to assemble the container. Additionally, the absence of the separate hinge pins reduces the likelihood of damage to the container in this area (i.e., the hinge pin is one component that is easily damaged and requires repair).

The snap-hooks 36 are shown extending upward from the upper surface 24 of the base portion 12, with the generally C-shaped (from a side perspective) hook portion curved toward the projections 26 extending along the edge of the sides of the base portion 12. Positioning the snap-hook 36 in this manner avoids problems associated from hinge elements that extend from the side of the container (e.g., from the projection 26). Such side mounted hinge elements tend to fail if the side wall or base projection bows outwardly. This tends to happen in some containers after a period of use.

Each end 32, 34 of the base portion 12 includes interlock tabs 40 and a central locking tab 42, which cooperate with structure on the lower portion of the end walls 18, 20 to hold the end walls 18, 20 in place when the container is set up in an unfolded configuration.

The central tab 42 is provided with a window 44 which extends through an upper surface of the tab. The window 44 allows for easy visual inspection of the container to ensure the end walls 18, 20 are properly positioned and snapped into place. When the end wall is properly situated in an upright position, a snap tab or other structure in the end wall cooperating with the central tab 42 will be visible through the window 44. This feature can be facilitated by making the end walls 18, 20 a different color or design than the base portion 12 of the container 10 (or at least by making the bottom of the end walls or snaps, and the central tab different colors or designs).

The upper surface 24 of the base portion 12 also includes a plurality of inclined projections 46 positioned proximate each end 32, 34 of the base portion 12. The inclined projections 46 each include an inclined surface 48 (formed as three ribs each having an inclined or slanted top surface) which extend upward from the surface 24 toward the respective ends 32, 34. A flat or horizontal surface 50 extends from the top of the inclined surface 48 toward a respective end of the bottom. The inclined surface 48 allows the bottom portion of the end walls 18, 20 to cam over the projections and lock in place in the assembled configuration.

Figure 3:
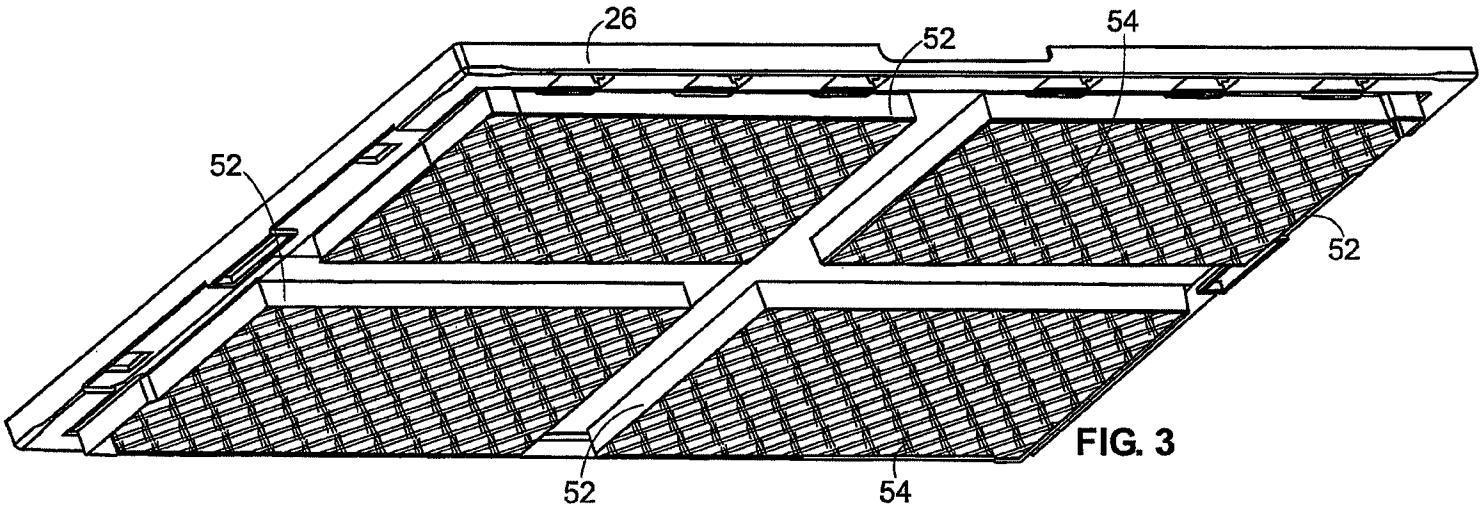
FIG. 3 is a bottom perspective view of the base portion of FIG. 2.
Figure 4:
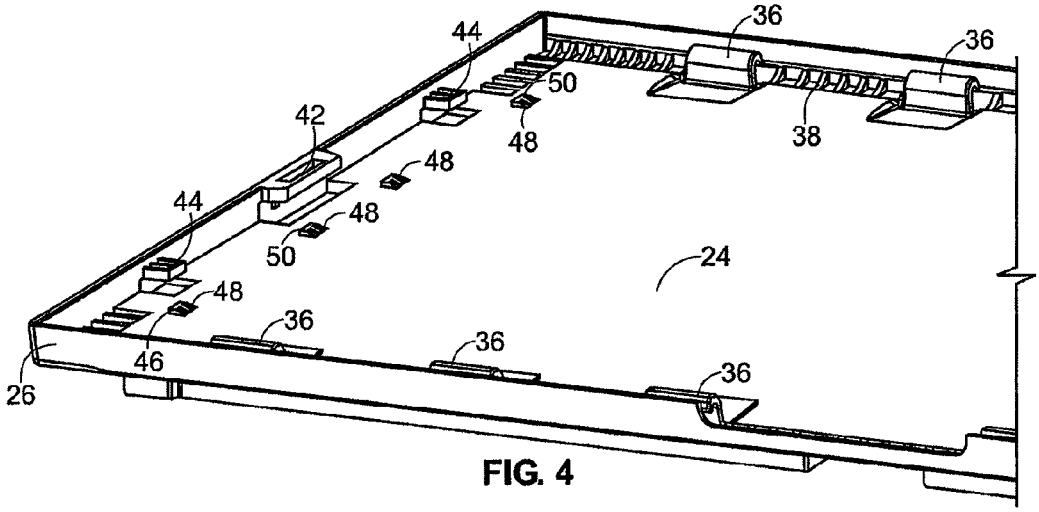
FIG. 4 is a partial top perspective view of one end of the base portion of FIG. 2.

Referring to FIG. 3, the bottom of the base portion 12 includes a plurality of feet 52. Each foot 52 is provided with a plurality of cross-ribs 54.

The sidewalls 14, 16 of the container 10 are snap-fittingly connected to the base portion 12, as well as to the rim portion 22, to form a hinged connection at the base and rim respectively. The sidewalls 14, 16 are configured to collapse inwardly toward the interior of the container 10 in a folded configuration. To accomplish this, each of the sidewalls 14, 16 comprises two components, a lower sidewall portion 56 and an upper sidewall portion 58 hingedly connected to the lower sidewall portion 56.

Figure 5:
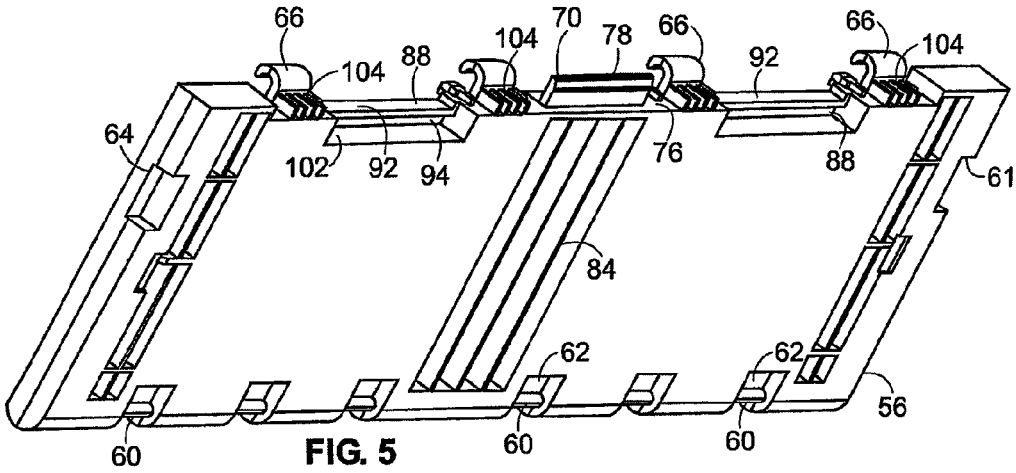
FIG. 5 is a perspective view of the interior side of a bottom portion of a sidewall of the container of FIG. 1.
Figure 6:
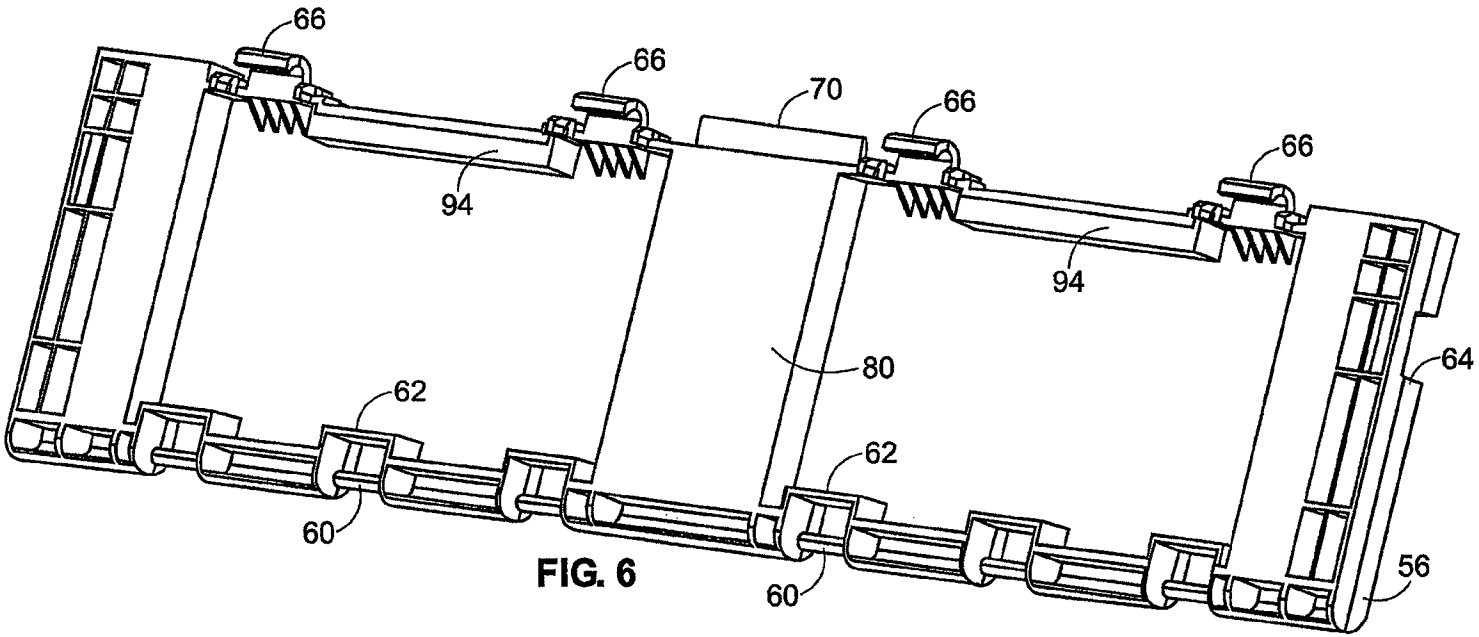
FIG. 6 is a perspective view of the exterior side of a bottom portion of a sidewall of the container of FIG. 1.

FIGS. 5 and 6 provide perspective views of the interior side and the exterior side, respectively; of the lower sidewall portion 56 (the terms "interior" and "exterior" are made with reference to the container in an assembled, unfolded configuration as shown in FIG. 1). At a lower end, the lower sidewall portion 56 includes a plurality of integrally formed hinge elements comprising hinge axles 60 spanning from a first wall to a second wall of rectangular shaped gaps 62. The hinge axles 60 are positioned to match up with the snap-hooks 36 arranged along the sides of the base portion 12. The gaps 62 are sized to allow the C-shaped ends of the snap-hooks 36 to pass between the hinge axles 60 and the rest of the lower sidewall portion to engage the axles 60 and hingedly connect the lower sidewall portion 56 to the base portion 12.

Each end of the lower sidewall portion 56 is provided with a notch 64 extending from the interior side of the sidewall portion 56. The notch 64 is positioned and sized to cooperate with the interlock tab 40 on the base portion 12 when the sidewalls 14, 16 are collapsed or folded down into the base portion 12 of the container. The interlock tab 40 fits in the notch 64 and prevents the lower sidewall portion 56 from moving. This prevents the lower and upper (which is connected to the lower sidewall portion as described herein) sidewall portions 56, 58 from moving laterally and increases the stability of the container in the collapsed configuration. In the design shown in the Figures, the lower sidewall portion 56 is sized so that it will not contact the central tab 42 on the base portion 12. However, another notch can be provided (at the top of the lower sidewall portion) if a larger sidewall is desired. Moreover, the lower sidewall portion 56 can include additional notches to match additional tabs or other structures extending upward from the base portion 12 (i.e., additional tabs or structures can be added to the base portion depending on size and stability requirements of the container).

The top of the lower sidewall portion 56 includes a plurality of integrally formed snap-hooks 66 configured to cooperate with hinge axles or pins 68 integrally formed on the bottom of the upper sidewall portion 58. The combination of the snap-hooks 66 and the hinge axles 68 provides a hinged connection between the lower sidewall portion 56 and the upper sidewall portion 58. The snap-hooks 66 and hinge axles 68 are configured to allow the lower sidewall portion 56 and the upper sidewall portion 58 to rotate with respect to each other so that the entire sidewall 14 or 16 collapses or folds about the hinged connection into the interior of the container. The lower sidewall portion 56 also rotates about the hinged connection to the base portion 12 so that the interior surface of the lower sidewall portion 56 lays flat on the upper surface of the base portion 12. In the collapsed state, the exterior surface of the upper sidewall portion 58 lays flat on top of the exterior surface of the lower sidewall portion 56.

The top of the lower sidewall portion 56 also includes an integrally formed, centrally located blade 70. The blade 70 extends upward and is configured to fit into an integrally formed pocket 72 centrally located on the bottom of the upper sidewall portion 58. The pocket 72 has a generally rectangular lower surface 74 which contacts an upper surface 76 of the lower sidewall portion 56 surrounding a lower portion of the blade 70. The rectangular surface 74 acts as a landing for distributing compressive forces on the container 10 (e.g., from other containers stacked on top of the present container). Similarly, the upper surface 78 of the blade 70 contacts an interior upper surface (not shown) of the pocket 72 to further facilitate distribution of compressive forces.

The blade 70 and pocket 72 work with aligned column supports 80, 82 on the lower sidewall portion 56 and upper sidewall portion 58, respectively, to create a centrally located load area for the container 10. The column supports 80, 82, each include a plurality of support ribs 84, 86 extending toward the interior of the container 10.

The blade 70 and pocket 72 also work together to make sure the lower and upper sidewall portions 56, 58 are aligned when the container 10 is in an assembled or unfolded configuration. The blade 70 and pocket 72 also strengthen the sidewalls 14, 16 from internal or external lateral forces applied to the sidewalls 14, 16 of the container 10.

Figure 7:
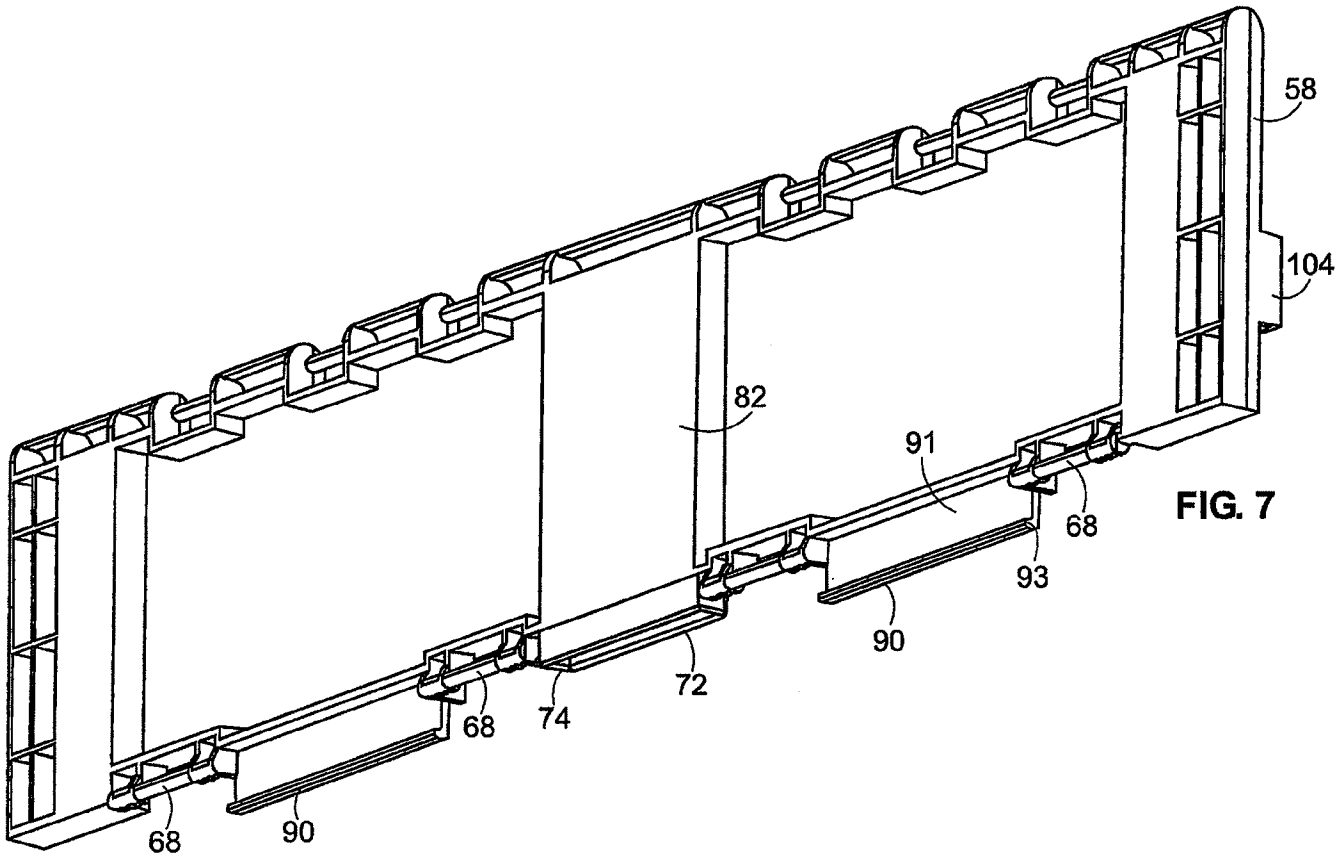
FIG. 7 is a perspective view of the exterior side of a top portion of a sidewall of the container of FIG. 1.

On either side of the blade 70, the lower sidewall portion 56 includes a first and second pocket 88 designed to cooperate with a corresponding first and second L-shaped (in cross-section) hook 90 (as illustrated in FIG. 7) on the upper sidewall portion 58. The L-shaped hook 90 includes a generally planar wall 91 section extending downward from the upper side wall portion 58, and a horizontal ledge 93 extending from the end of the planar wall 91. The pockets 88 are open to the interior of the container 10 when assembled. Each pocket 88 includes a horizontal wall or shelf 92 at the top of the pocket 88 extending from a vertical wall 94 of the pocket 88. The pockets 88 are each positioned between two of the snap-hooks 66 on the lower sidewall portion 56.

Figure 8:
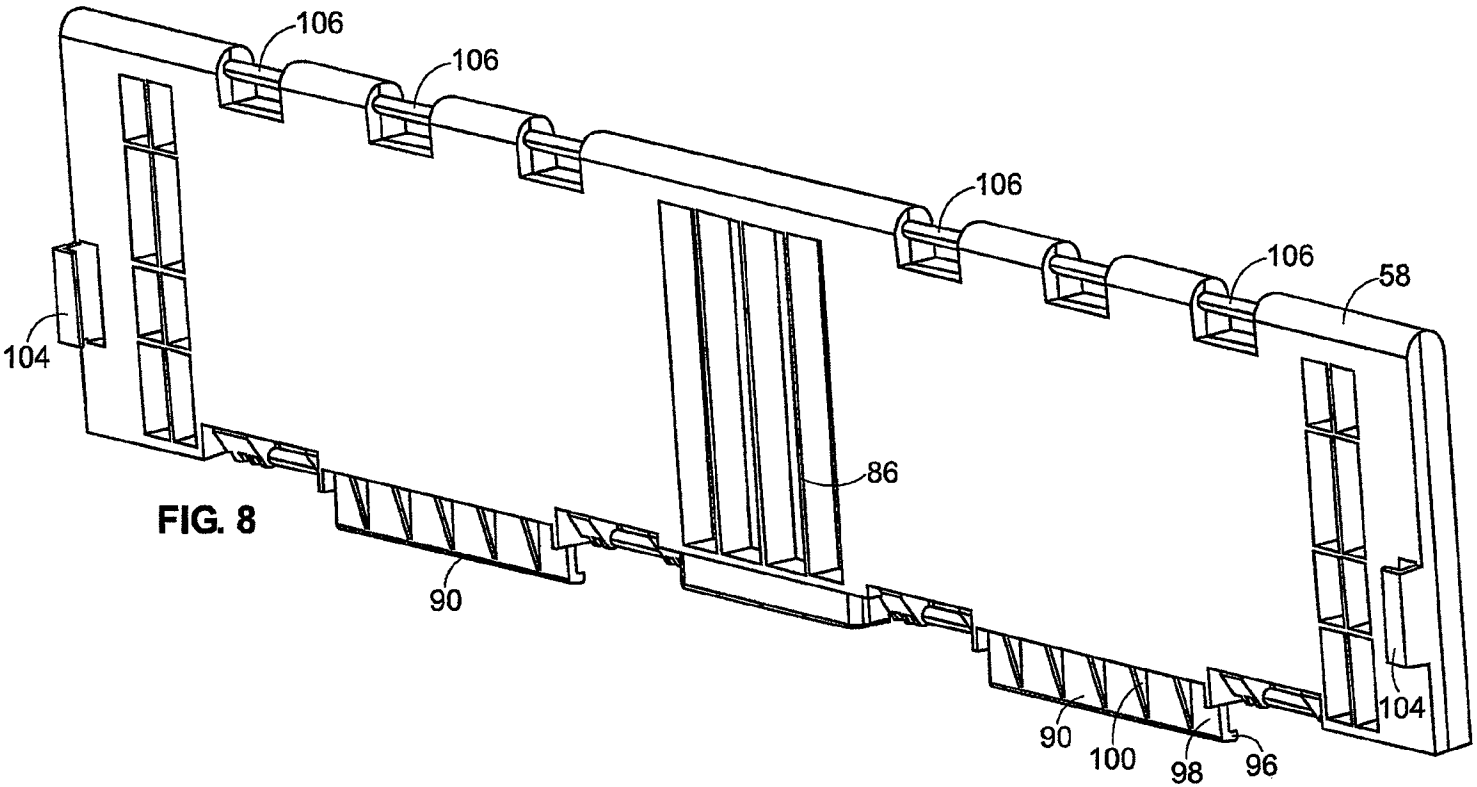
FIG. 8 is a perspective view of the interior side of a top portion of a sidewall of the container of FIG. 1.

Similar to the pockets 88, the L-shaped hooks 90 are positioned between two of the hinge axles 68 on the upper sidewall portion 58 and are aligned with the pockets 88 when assembled. Each L-shaped hook 90 includes a horizontal wall or shelf 96 extending from a bottom of a vertical wall 98. The wall 96 of the L-shaped hook 90 projects outward from the vertical wall 98 away from the interior of the container 10. A plurality of support ribs 100 extend along an interior side of the L-shaped hook 90 as shown in FIG. 8.

During use, the pockets 88 and L-shaped hooks 90 cooperate to take up the load on the sidewalls 56, 58. When a loaded container 10 is lifted (e.g., by handles described below) the upper sidewall portion 58 is moved upward (through its connection to the rim 22. This causes the upper surface of the horizontal wall 96 of the L-Shaped hook 90 to engage the lower surface of the horizontal wall 92 of the pocket 88. This engagement takes up any tension between the upper sidewall portion 58 and the lower sidewall portion 56 during lifting and protects the hinge structure (i.e., snap-hooks 66 and hinge axles 68) from such forces.

Additionally, the pocket 88 and L-shaped hook 90 also cooperate to distribute compressive load forces applied to the container 10. For example, when one or more loaded containers are stacked on the present container 10, the horizontal wall 96 of the L-shaped hook 90 engages a bottom surface 102 of the pocket 88. This allows the pocket 88 and L-Shaped hook 90 to support and distribute the load on the sidewalls 56, 58 of the container 10. Again, this acts to protect the hinge structure (i.e., snap-hooks 66 and hinge axles 68) from such forces.

The top of the lower sidewall portion 56 also includes a plurality of ribs 104 positioned behind each snap-hook 66. The ribs 104 prevent the snap-hooks 66 from rotating too far with respect to the upper sidewall portion 58 so that the sidewall will not bow outward.

The upper sidewall portion 58 includes an end wall hook 104 on both ends of the upper sidewall portion. The end wall hooks 104 or configured to catch or engage structure in the end walls 18, 20 when the container 10 is in an unfolded configuration. This locks the sidewalls 56, 58 to the end walls 18, 20 and increases the stability of a set-up container.

The top of the upper sidewall portion 58 includes a plurality of hinge axles or pins 106. The hinge axles 106 engage snap-hooks in the rim 22 to provide a rotational connection between the upper sidewall portion 58 and the rim 22 similar to the connection between the lower sidewall portion 56 and the base 12.

FIGS. 9-12 depict an end wall 18 or 20 of the container 10. The end walls 18, 20 of the container 10 are rotationally mounted to the rim 22 via integrally formed hinge axles or pins 108 as described below. The end walls 18, 20 are mounted to swing toward the interior of the container when folding the container to a collapsed configuration.

Figure 9:
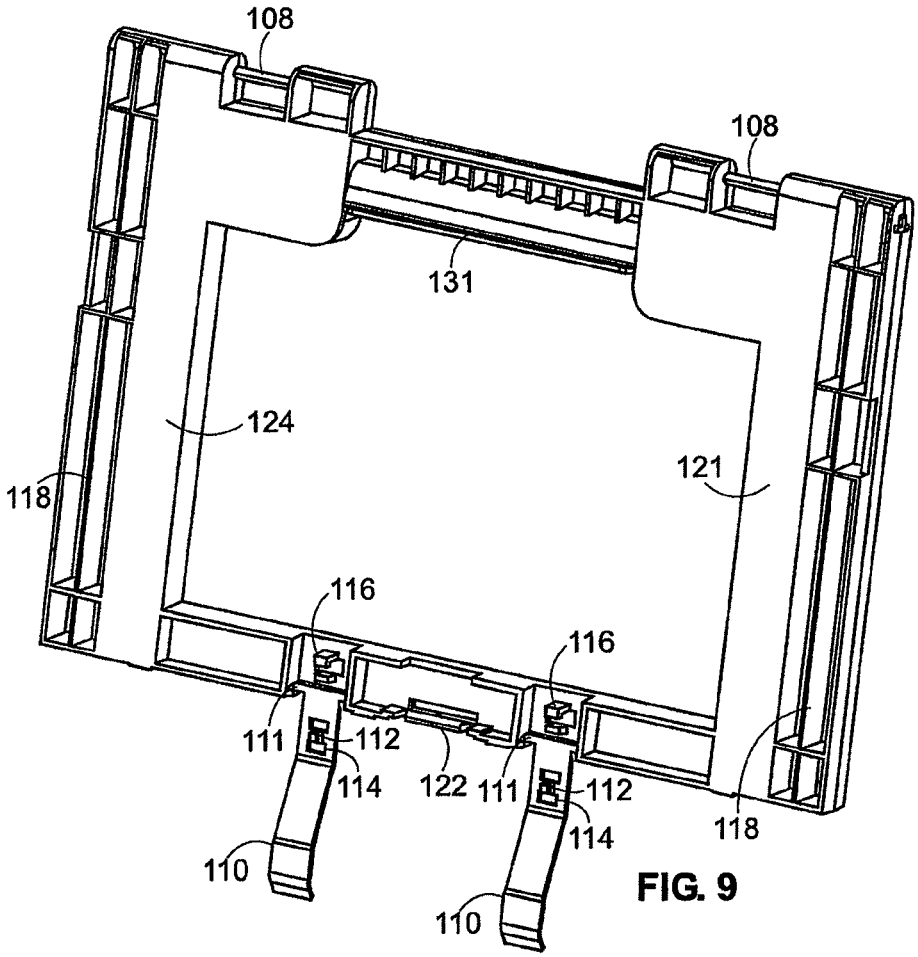
FIG. 9 is a perspective view of an exterior side of an end wall of the container of FIG. 1 with two hinge elements in an open position.
Figure 10:
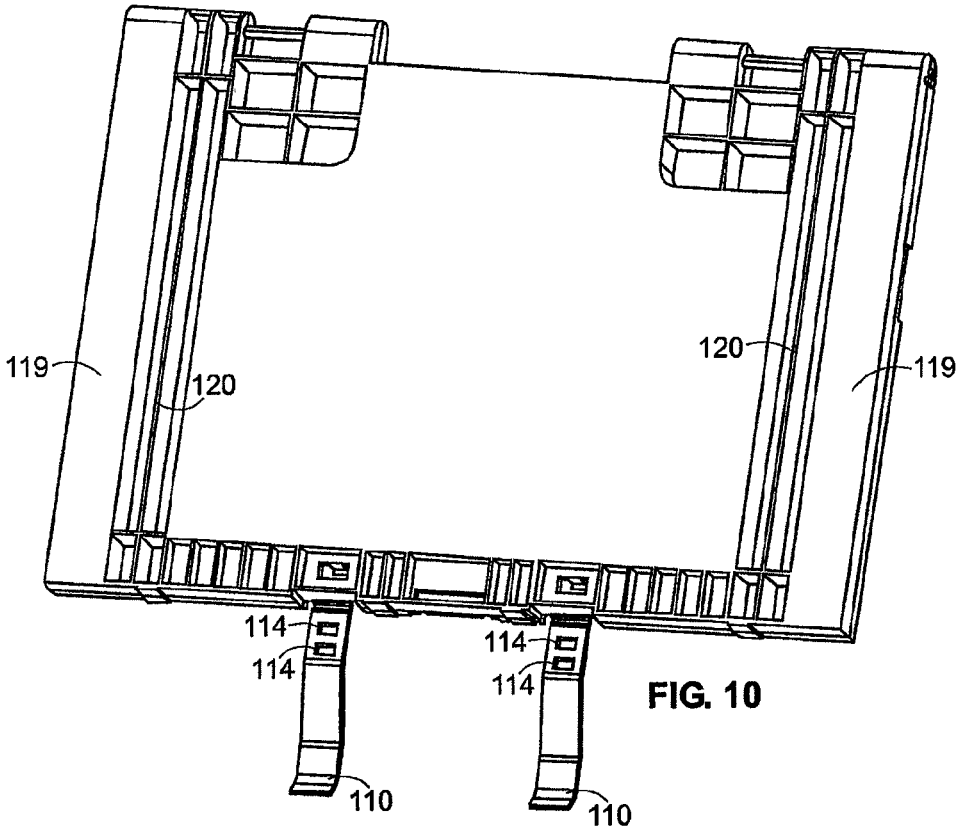
FIG. 10 is a perspective view of an interior side of an end wall of the container of FIG. 1 with two hinge elements in an open position.
Figure 11:
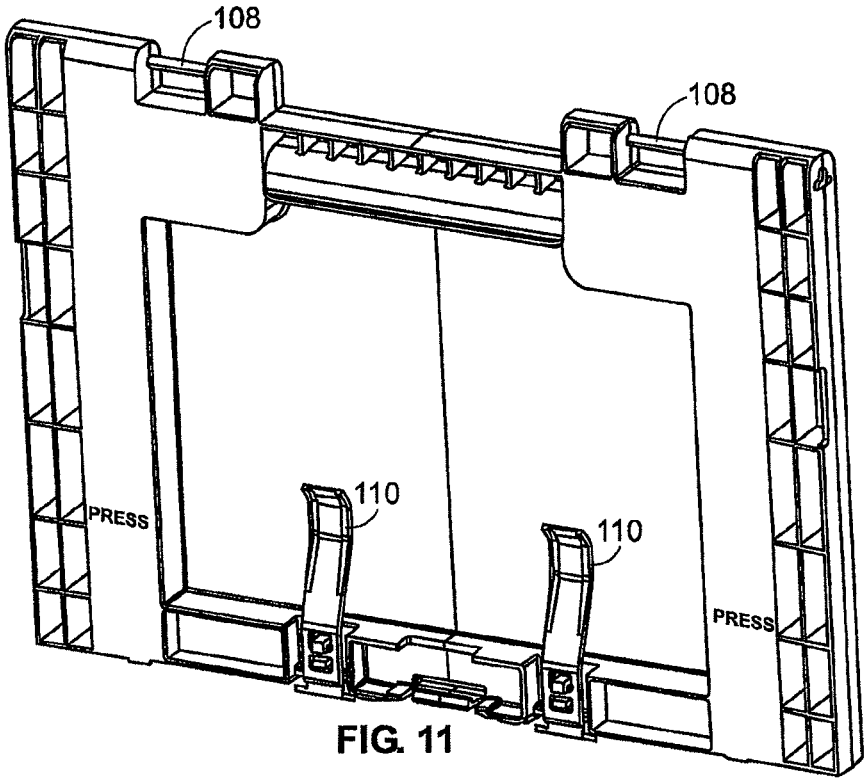
FIG. 11 is a perspective view of an exterior side of an end wall of the container of FIG. 1 with two hinge elements in a closed position.

Each of the end walls 18, 20 include integrally formed first and second cardholder prongs 110. As shown in FIGS. 9 and 10, the cardholder prongs 10 extend downward from the bottom of the end wall when removed from a forming mold. The prongs 110 are then moved upward about a living hinge 111 formed in the prongs, to an upright position illustrated in FIGS. 1 and 11. A projection 112 and openings 114 on the prongs 110 coordinate with snap elements 116 on the end wall to snap the cardholder prongs 110 in place. The cardholder prongs 110 are curved at the top ends to contact the end wall. The prongs 110 are used to secure an information card against the exterior side of the end wall.

The sides of the end walls are reinforced with a plurality of ribs 118 extending toward the exterior of the container 10 from an interior facing planar surface 119, and an adjacent plurality of ribs 120 extending toward the interior of the container 10 from an exterior facing planer surface 121. This reinforcement facilitates distribution of loads applied to the corners of the container 10.

When assembled to an unfolded configuration, the bottom of the end wall is captured by the interlock tabs 40 and the central locking tab 42 in the base portion 12 of the container 10. The interlock tabs 40 are positioned outward from the center of the end wall toward the reinforced ribbed sides 118-121 of the end wall. This positioning provides greater stability when the container 10 is in an unfolded configuration.

Figure 12:
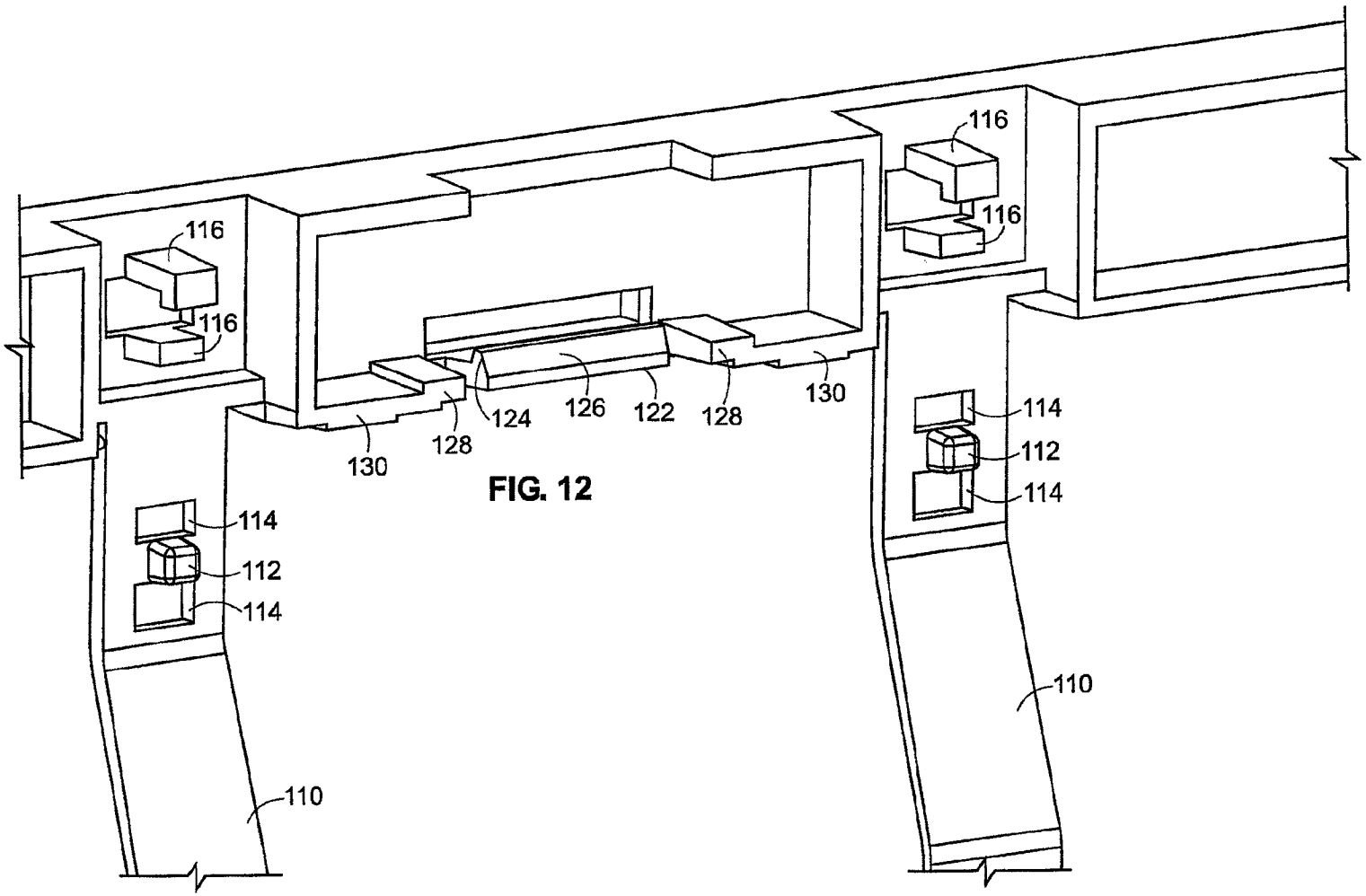
FIG. 12 is a partial perspective view of an exterior side of a central bottom portion of the end wall of FIG. 9.

The central tab 42 in the base portion 12 is configured to mate with a snap element 122 centrally located at the bottom of the end wall. Referring to FIG. 12, the snap element 122 includes an upwardly projecting ridge 124. The ridge 124 includes an inclined surface 126 which forces the snap element 122 to deflect downward as it engages the inner portion of the central tab 42 in the base portion 12. The ridge 124 then snaps upward into the window 44 of the central tab 42. As discussed, making the end wall (or at least the ridge 124 of the snap element 122) a different color than the central tab 42 allows for easy visual inspection that the end wall is properly positioned in the unfolded configuration and is locked into place.

To avoid undue load being applied to the snap element 122 (which can lead to fatigue or a slight bowing or bending of the element after a period of time), the end wall is provided with a first and second support 128 laterally spaced from, and on either side of the snap element 122. The supports 128 engage the lower surface of the sides of the central tab 42 and absorb any loads applied to the central tab 42. The supports 128 are stepped up from bottom walls 130 (on each side of the snap element 122) extending outward from the end wall.

Each end wall also includes a handle grip 131 centrally located proximate the top of the end wall. The handle grips 131 facilitate lifting and movement of the container 10.

Figure 13:
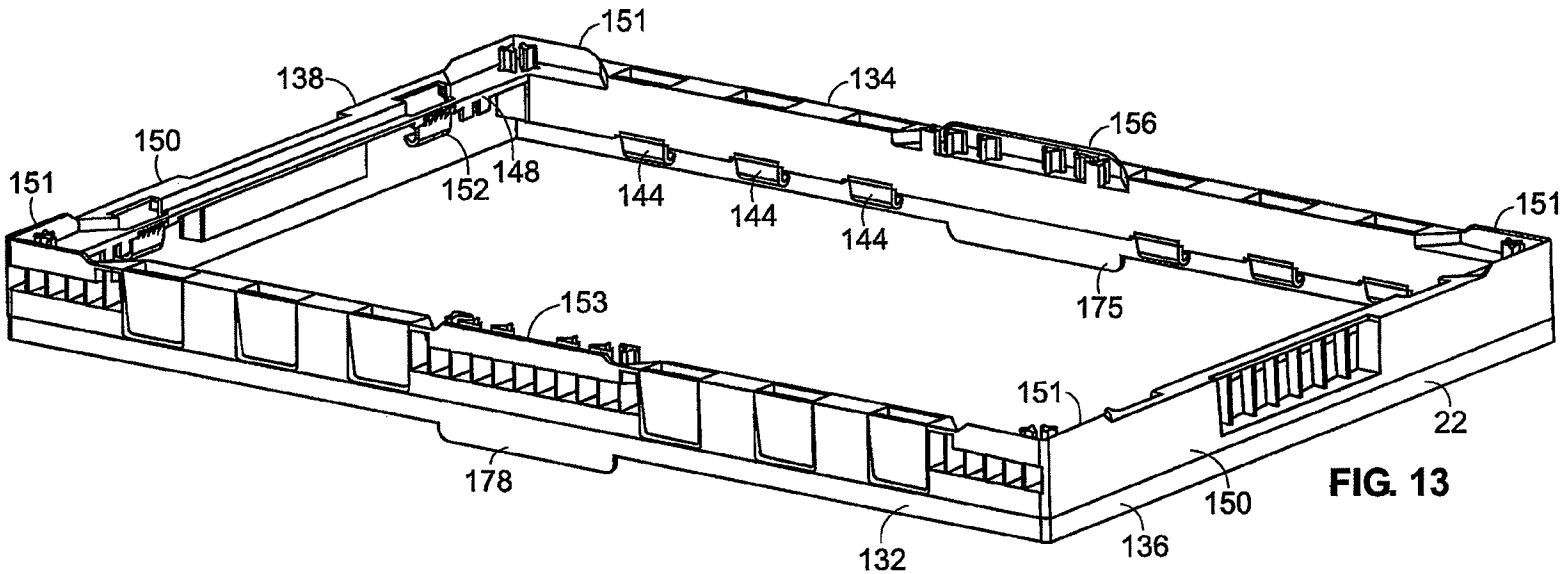
FIG. 13 is a perspective view of a top of a rim of the container of FIG. 1.
Figure 14:
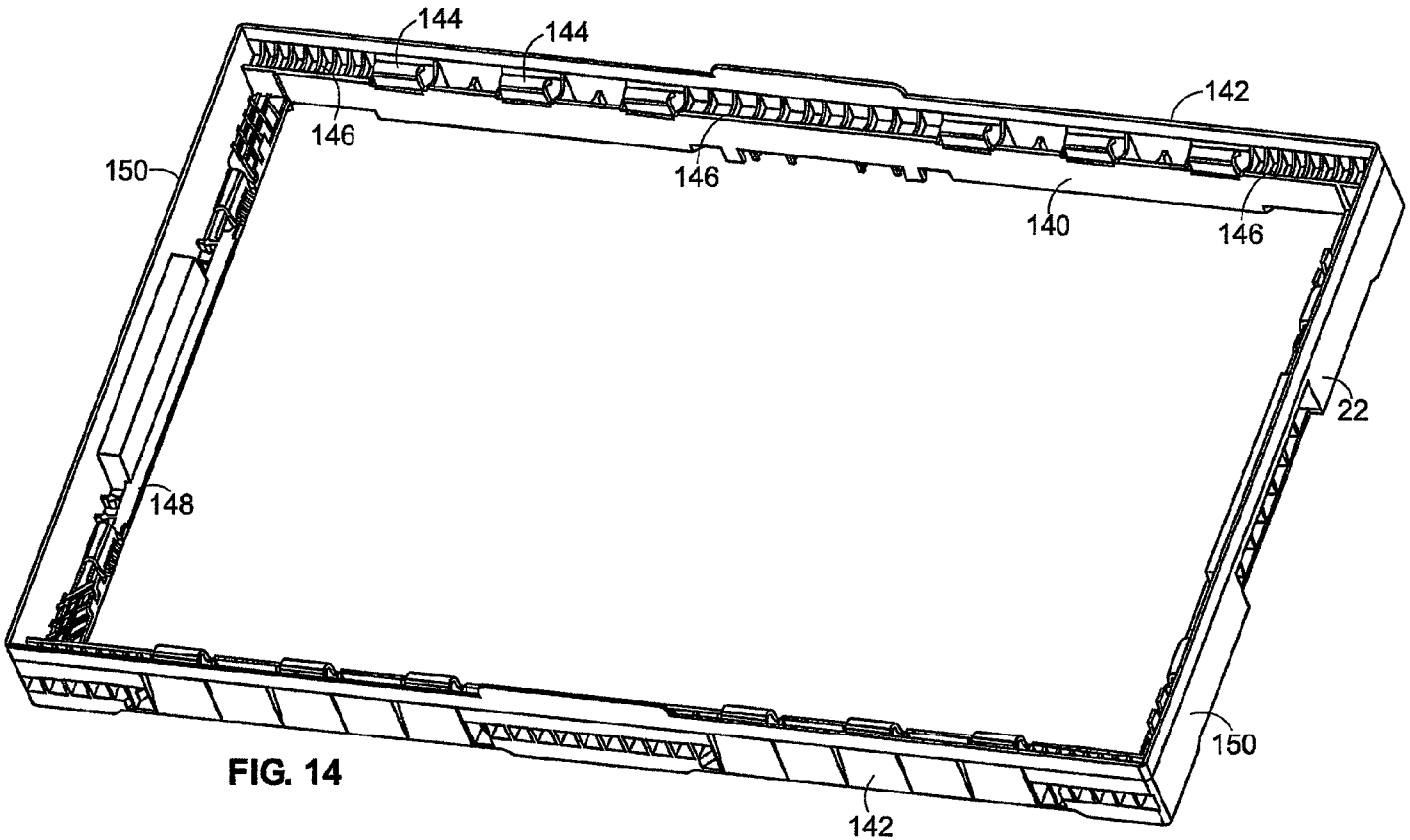
FIG. 14 is a perspective view of a bottom of a rim of the container of FIG. 1.

FIGS. 13 and 14 show the top and bottom of the rim 22 of the container 10. The rim 22 is generally rectangular having a first side 132, an opposing second side 134, a first end 136 and an opposing second end 138. The sides 132, 134 and ends 136, 138 extend around a central opening.

The sides 132, 134 of the rim 22 have a double wall construction with an inner wall 140 and an outer wall 142. Similar to the base portion 12, a plurality of snap-hooks 144 extend downward from the inner wall 140 of the sides 132, 134 of the rim 22. As illustrated in FIG. 14 (showing the rim 22 turned over), a plurality of curved ribs 146 extend between the inner wall 140 and the outer wall 142. The snap-hooks 144 and ribs 146 engage the hinge axles 106 at the top of the upper sidewall portion 58 to rotationally connect the sidewall to the rim 22. Again, similar to the base portion 12, the snap-hooks 144 have a first angled ramp portion 170 and a second angled ramp portion 172 to facilitate connection with the hinge axles 106 as explained herein.

The ends 136, 138 of the rim 22 also have a double wall construction with an inner wall 148 and outer wall 150 (although the inner wall 148 is not as pronounced as the inner wall 140 of the sides 132, 134). Hook snaps 152 extend downward from the inner wall 148 and are designed to engage the hinge axles 108 on the end walls 18, 20 to rotationally connect the end walls 18, 20 to the rim 22.

The rim portion 22 is provided with a plurality of raised portions along the outer wall 142 that extend upward above the remainder of the top of the rim portion 22. Preferably, each corner includes a raised portion 151. Additionally, the mid portion of the sides 132, 134 includes a raised portion 153. The raised portions 151, 153 contact or support other containers stacked on the present container 10, and help direct the load forces through the corners and mid section of the container 10.

Figure 15:
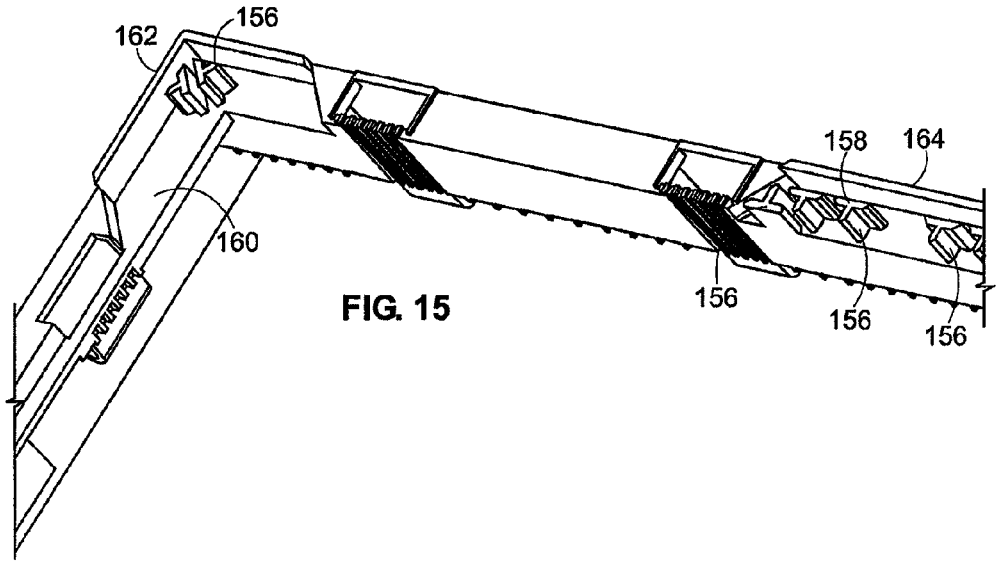
FIG. 15 is an enlarged perspective view of a portion of the rim of FIG. 13.

Referring to FIGS. 13 and 15, the rim 22 includes a plurality of T-shaped ribs 156 extending upward from the corners 162, as well as the mid-sections 164 of the sides 134, 136 of the rim portion 22. The T-Shaped ribs 156 act as load-bearing stanchions for supporting containers or other items stacked on top of the container 10. The T-shaped ribs 156 are integrally formed or molded in the rib portion 22.

The T-shaped ribs 156 include a flat, upper load-bearing surface 158. A container, stacked on top of the present container 10, will rest on the load-bearing surface 158. The T-shaped ribs 156 prevent the bottom of the stacked container from resting on a ledge 160 extending into the container from the outer walls of the rim portion 22.

The T-shaped ribs 156 can interact with corresponding structure on the bottom of another container to lock the container in position when stacked on top of the rim portion 22 of the present container. The T-shaped ribs 156 are strategically positioned in the corners 162, and midway 164 along the sides of the rim portion 22. This allows for stacking a same size container, a half size container, or cross-stacking of containers. The T-shaped ribs 156 also prevent another container from causing the rim portion 22 and/or side walls from bowing outwardly, which would allow the container on top to slip into the interior of the lower container.

Additional T-shaped ribs 156 can be formed into the rim portion 22 as desired or required depending on size and strength considerations. Also, the size and cross-sectional shape of the ribs can be modified as desired.

Unlike prior folding containers, the present container 10 does not include any separate pins or other separate axles for allowing rotational movement of components. That is, all of the hinge elements are integrally formed in the components of the container (e.g., base portion, side walls, end walls and rim portion). The lack of separate pins also facilitates assembly of the container by eliminating steps previously needed for insertion of the pins. The components of the present container 10 simply snap together. In this regard, the snap-hooks, integrally formed hinge axles, and curved ribs are uniquely configured to interact to guide the components into the proper position.

Figure 16:
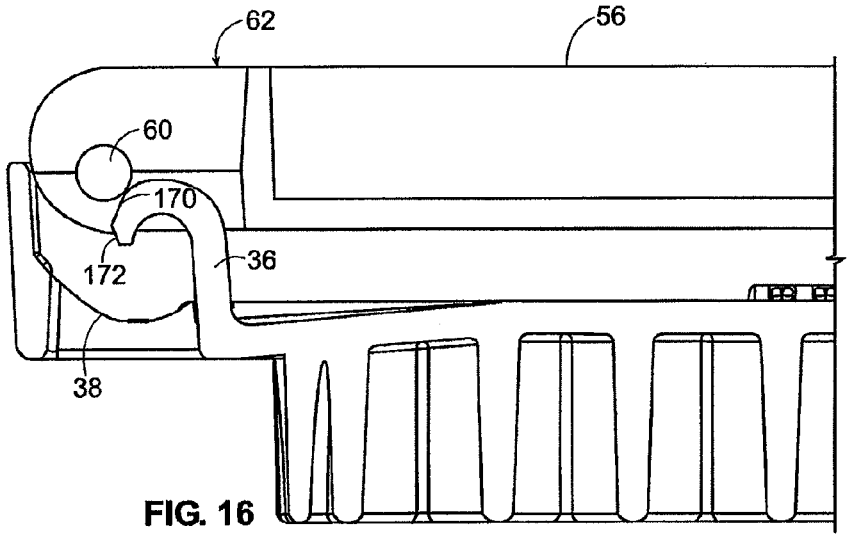
FIG. 16 is a cross-sectional view of a lower side wall portion and a base portion of the container illustrating a step for rotationally connecting the lower side wall portion to the base portion.
Figure 17:
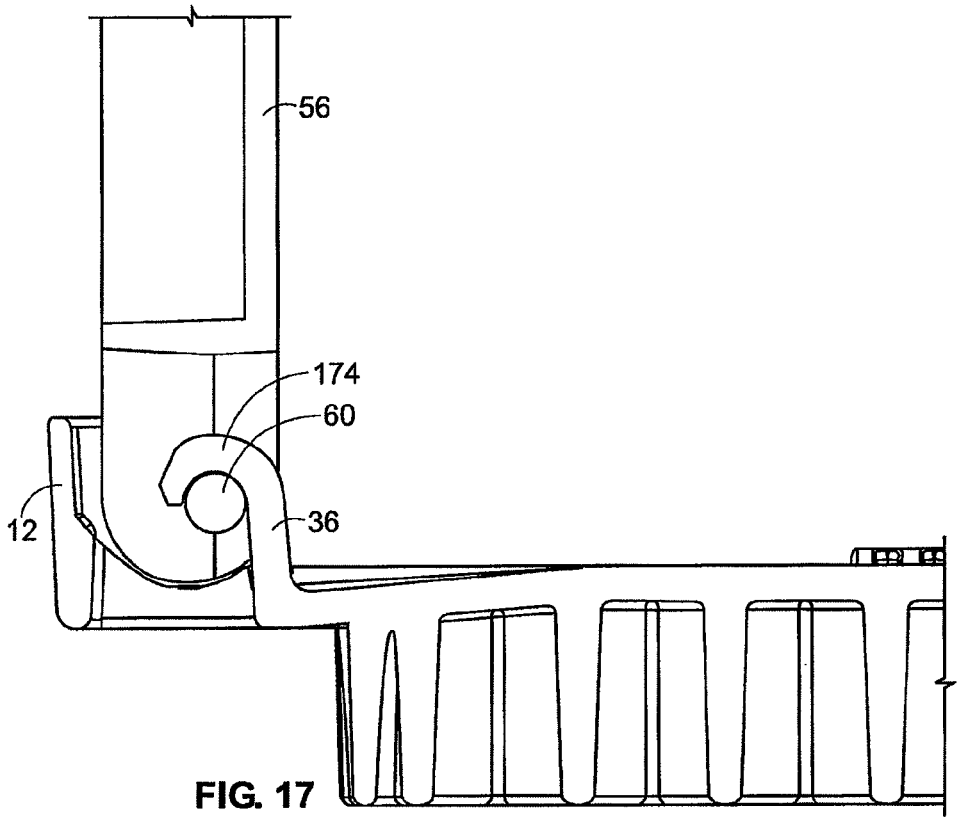
FIG. 17 is a cross-sectional view of a lower side wall portion and a base portion of the container illustrating another step for rotationally connecting the lower side wall portion to the base portion.
Figure 18:
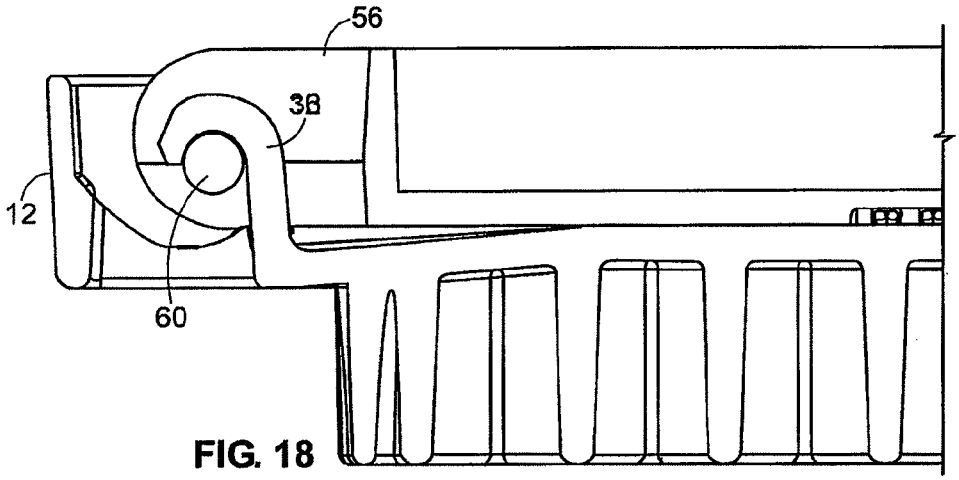
FIG. 18 is a cross-sectional view of a lower side wall portion and a base portion of the container illustrating folding the lower side wall portion into the base portion after rotationally connecting the lower side wall portion to the base; and, FIG. 19 is a perspective view of a portion of the rim of a partially folded assembled container during a hot stamping procedure.

Referring to FIGS. 16-18, a lower side wall portion 56 is shown being connected to the base portion 12. The side wall portion 56 is first laid on top of the base in the collapsed orientation with the hinge axle 60 resting on a first inclined ramp segment 170 formed in the snap-hook 36. The first ramp segment 170 is provided to snap the side wall portion 56 into a second position. The hinge axle 60 is guided downward until it reaches a second ramp segment 172 at the end of the snap-hook 36. The second ramp segment 172 angles back toward the interior portion of the hook.

The side wall portion 56 is then rotated to stand in an upright position as shown in FIG. 17. This causes the hinge axle 60 to snap into place in the snap-hook 36. The curved ribs 38 adjacent the snap-hook 36 contact the rounded bottom of the side wall portion 56 and assist in guiding the side wall portion 56 into the proper snapped position. Additionally, the curved ribs 38 also help keep the side wall portion 56 in place with the axle 60 securely set in the hook portion 174 of the snap-hook 36.

Once the plurality of hinge axles 60 in the side wall portion 56 are properly positioned in the corresponding snap-hooks 38 extending upwardly from the bottom portion 12, the axle/snap-hook combinations collectively form a hinge about which the side wall portion 56 can rotate. As illustrated in FIG. 18, the side wall portion 56 is shown rotated about the axle/snap-hook combinations into a collapsed or folded configuration with the side wall portion 56 laying flat on the bottom portion 12.

The upper side wall portion 58 is connected to the rim portion 22 in a similar manner as the lower side wall portion 56 is connected to the bottom portion 12. The hinge axles 106 in the top of the upper side wall portion 58 are configured to snap into the snap-hooks 144 extending along the sides of the rim portion 22 in the same way as the hinge axles 60 snap into the snap-hooks 36. In this regard, the snap-hooks 144 are configured to have the first and second ramp segments of the snap-hooks 36. Additionally, the rim portion 22 is also provided with curved ribs 46 which cooperate with the rounded top of the upper side wall portion 58 between the hinge axles 106, to facilitate guiding and keeping the upper side wall portion 58 in place.

The hinge axles 108 of the end walls 18, 20 are snapped into the snap-hooks 152 extending downwardly from the ends of the rim portion 22 in the same manner as that described with respect to the lower and upper side wall portions 56, 58. Again, the snap-hooks 152 include the ramp segments for facilitating connection of the end walls 18, 20 to the rim portion 22.

Unlike prior folding containers, the present container 10 is configured to allow for hot stamping after assembly of the container. A hot stamping operation typically involves placing a portion of a container between a die head on one side, and a support piece on the other side. A thin film—containing a design or indicia to be stamped onto the container portion (typically, the name or logo of a purchasing company of the container)—is positioned between the die head and the surface of the container portion to be stamped (typically an exterior surface of the container). In the past, it was necessary to perform any hot stamping operations before assembling the container in order to adequately position the support piece behind the portion of the container to be stamped.

Placing the stamp on a component of the container before assembly meant knowing exactly how many containers would be purchased or utilized having a particular stamp applied to them. Thus, if more containers were stamped than needed for a particular purchaser or use, they had to be stored until later purchases by the same entity or similar uses, or the component of the container stamped had to be replaced with another (having a different stamp for a different purchaser or use).

Figure 19:
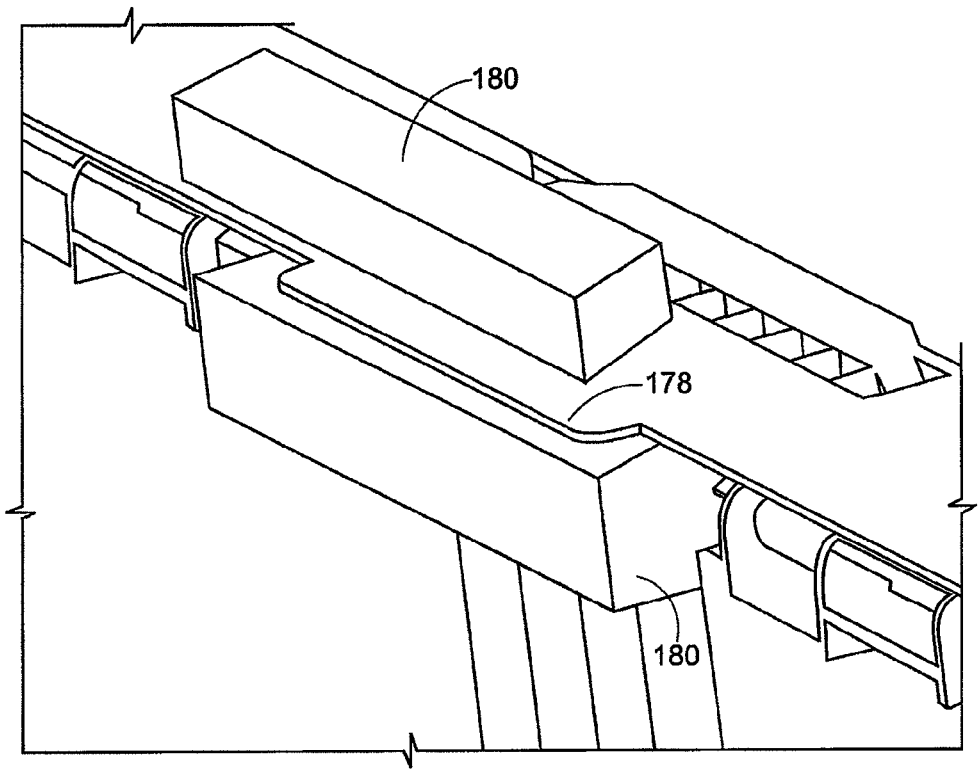

Referring to FIGS. 13 and 19, the present container 10 includes tabs 178 in the outer wall on each side of the rim portion 22 which extend downward below the remainder of the rim portion. The tabs 178 are positioned approximately mid way between the ends of the rim portion. Because the tabs extend below the remainder of the rim portion (at least along the sides of the rim portion), the back or interior surface of each tab 178 can be supported when the container is assembled and in a partially folded configuration. As illustrated in FIG. 19, a support piece 180 of a hot stamping machine (not shown) can be positioned against the back or interior side of the tab 178. This allows a die head 182 to press against the exterior surface of the tab 178. A thin film placed between the die head 182 and the exterior surface of the tab 178, will be hot stamped onto the tab. Being able to hot stamp the container after assembly allows for maintaining inventories of assembled containers. A stamp can be placed on the number of containers purchased by a customer without anticipating exactly how many containers the customer would need.

Many of the components described above with respect to the preferred embodiment include structures which cooperate and engage with structures on other components. In many instances, the engaging structures can be reversed and positioned on the opposing component. For example, the snap-hooks on the top of the lower sidewall portion and the hinge axles on the bottom of the upper sidewall portion—which form the hinged connection between the lower sidewall portion and the upper sidewall portion—can be reversed such that the hinge axles are formed at the top of the lower sidewall portion and the snap-hooks are formed in the bottom of the upper sidewall portion.

While the specific embodiments have been illustrated and described, numerous modifications come to mind without significantly departing from the spirit of the invention, and the scope of protection is only limited by the scope of the accompanying Claims.

What is claimed is:

1. A folding container with a locking feature comprising:

a rectangular base portion having a first side and a second side, a first end and a second end and a bottom surface extending between the first side, second side, first end and second end;

a first rectangular side wall having a first side proximate the first end of the base portion and a second side proximate the second end of the base portion hingedly connected to the first side of the base portion, the first side wall including a first notch along the first side of the side wall; and, a first interlock tab in the base portion positioned proximate the first end to engage the first notch in the first side wall when the container is in a collapsed configuration to prevent the first side wall from moving laterally.

2. The folding container of claim 1 comprising a second notch in the first side wall; and, a second interlock tab in the base portion positioned to engage the second notch in the first side wall when the container is in a collapsed configuration.

3. The folding container of claim 1 wherein the first interlock tab extends inwardly from the first end of the base portion.

4. The folding container of claim 2 wherein the second interlock tab is located proximate the second end of the base portion.

5. The folding container of claim 2 further comprising:

a second side wall hingedly connected to the second side of the base portion, the second side wall including a first notch; and, a third interlock tab in the base portion positioned to engage the first notch in the second side wall when the container is in the collapsed configuration.

6. The folding container of claim 5 comprising:

a second notch in the second side wall; and, a fourth interlock tab in the base portion positioned to engage the second notch in the second side wall when the container is in a collapsed configuration.

7. The folding container of claim 6 wherein the third interlock tab is located proximate the first end of the base portion and the fourth interlock tab is located proximate the second end of the base portion.

8. The folding container of claim 7 further comprising:

a first projection extending upward from the first end of the base portion and where each of the first interlock tab and the second interlock tab extend toward the interior of the folding container from a top portion of the first projection and are spaced from the bottom surface by a gap; and, a second projection extending upward from the second end of the base portion and where each of the third interlock tab and the fourth interlock tab extend toward the interior of the folding container from a top portion of the second projection and are spaced from the bottom surface by a gap.

9. The folding container of claim 8 wherein the first side wall comprises a first lower side wall portion and a second upper side wall portion hingedly connected to the first lower side wall portion and wherein the first notch and the second notch of the first side wall are positioned on an interior of the first lower side wall portion of the first side wall, and the second side wall comprises a first lower side wall portion and a second upper side wall portion hingedly connected to the first lower side wall portion and wherein the first notch and the second notch of the second side wall are positioned on an interior of the first lower side wall portion of the second side wall.

10. The folding container of claim 9 further comprising:

a rectangular rim having a first side and an opposing second side, a first end and an opposing second end, the first side of the rim connected to the second upper side wall portion of the first side wall, and the second side of the rim connected to the second upper side wall portion of the second side wall.

11. The folding container of claim 10 further comprising:

a first end wall rotationally connected to the first end of the rim, the first end wall including a lip on a lower portion of the first end wall wherein the lip is captured by the first and second interlock tabs when the container is in an unfolded configuration; and, a second end wall rotationally connected to the second end of the rim, the second end wall including a lip on a lower portion of the second end wall wherein the lip is captured by the third and fourth interlock tabs when the container is in an unfolded configuration.

12. A folding container with a locking feature comprising:

a rectangular base portion having a first side and a second side, a first end and a second end, and a bottom surface extending between the first side, second side, first end and second end;

a first projection extending upward from the first end of the base portion;

a first interlock tab extending toward an interior of the container from a top portion of the first projection and spaced from the bottom surface;

a first side wall including a first notch positioned to engage the first interlock tab when in a collapsed configuration, the first side wall hingedly connected to the first side of the base portion; and, a second side wall hingedly connected to the second side of the base portion.

13. The folding container of claim 12 further comprising:

a second projection extending upward from the second end of the base portion;

a second interlock tab extending toward an interior of the container from a top portion of the second projection and spaced from the bottom surface; and, the first side wall including a second notch positioned to engage the second interlock tab when in a collapsed configuration.

14. The folding container of claim 13 further comprising:

a third interlock tab extending toward an interior of the container from a top portion of the first projection and spaced from the bottom surface;

a fourth interlock tab extending toward an interior of the container from a top portion of the second projection and spaced from the bottom surface; and, a second side wall having a first notch positioned to engage the third interlock tab when in a collapsed configuration, and a second notch positioned to engage the fourth interlock tab when in a collapsed configuration.

15. The folding container of claim 12 further comprising:

a rectangular rim having a first side and an opposing second side, a first end and an opposing second end, the first side of the rim connected to the first side wall, and the second side of the rim connected to the second side wall, and a first end wall rotationally connected to the first end of the rim, the first end wall including a lower portion that is captured by the first interlock tab when the container is in an unfolded configuration.

16. The folding container of claim 15 further comprising:

a second projection extending upward from the second end of the base portion;

a second interlock tab extending toward an interior of the container from a top portion of the second projection and spaced from the bottom surface;

a second end wall rotationally connected to the second end of the rim, the second end wall including a lower portion that is captured by the second interlock tab when the container is in an unfolded configuration.

17. The folding container of claim 14 further comprising:

a rectangular rim having a first side and an opposing second side, a first end and an opposing second end, the first side of the rim connected to the first side wall, and the second side of the rim connected to the second side wall;

a first end wall rotationally connected to the first end of the rim, the first end wall including a lip on a lower portion of the first end wall wherein the lip is captured by the first and second interlock tabs when the container is in an unfolded configuration; and, a second end wall rotationally connected to the second end of the rim, the second end wall including a lip on a lower portion of the second end wall wherein the lip is captured by the third and fourth interlock tabs when the container is in an unfolded configuration.

18. The folding container of claim 17 wherein the first side wall comprises a first lower side wall portion and a second upper side wall portion hingedly connected to the first lower side wall portion and wherein the first notch and the second notch of the first side wall are positioned on an interior of the first lower side wall portion of the first side wall, and the second side wall comprises a first lower side wall portion and a second upper side wall portion hingedly connected to the first lower side wall portion and wherein the first notch and the second notch of the second side wall are positioned on an interior of the first lower side wall portion of the second side wall.

19. A folding container having interlocking tabs to prevent movement of the walls in a folded position and in an unfolded position comprising:

a rectangular base portion having a first side and a second side, a first end and a second end and a bottom surface extending between the first side, second side, first end and second end;

a first side wall hingedly connected to the first side of the base portion, the first side wall including a first lower side wall portion and a second upper side wall portion hingedly connected to the first lower side wall portion, the first lower side wall portion including a notch on an interior side; and, a first interlock tab in the base portion positioned to engage the first notch in the first lower side wall portion wall when the container is in a folded configuration to prevent the first side wall from moving laterally;

a rectangular rim having a first side and an opposing second side, a first end and an opposing second end, the first side of the rim connected to the second upper side wall portion; and, a first end wall rotationally connected to the first end of the rim, the first end wall including a lower portion that is captured by the first interlock tab when the container is in an unfolded configuration.

20. A folding container with a locking feature comprising:

a rectangular base portion having a first side and a second side, a first end and a second end and a bottom surface extending between the first side, second side, first end and second end;

a first side wall hingedly connected to the first side of the base portion, the first side wall including a first notch;

a first interlock tab in the base portion positioned to engage the first notch in the first side wall when the container is in a collapsed configuration to prevent the first side wall from moving laterally;

a second notch to the first side wall; and, a second interlock tab in the base portion positioned to engage the second notch in the first side wall when the container is in a collapsed configuration;

a second side wall hingedly connected to the second side of the base portion, the second side wall including a first notch; and, a third interlock tab in the base portion positioned to engage the first notch in the second side wall when the container is in the collapsed configuration;

a second notch in the second side wall;

a fourth interlock tab in the base portion positioned to engage the second notch in the second side wall when the container is in a collapsed configuration, wherein the third interlock tab is located proximate the first end of the base portion and the fourth interlock tab is located proximate the second end of the base portion;

a first projection extending upward from the first end of the base portion and where each of the first interlock tab and the second interlock tab extend toward the interior of the folding container from a top portion of the first projection and are spaced from the bottom surface by a gap; and, a second projection extending upward from the second end of the base portion and where each of the third interlock tab and the fourth interlock tab extend toward the interior of the folding container from a top portion of the second projection and are spaced from the bottom surface by a gap.

21. The folding container of claim 20 wherein the first side wall comprises a first lower side wall portion and a second upper side wall portion hingedly connected to the first lower side wall portion and wherein the first notch and the second notch of the first side wall are positioned on an interior of the first lower side wall portion of the first side wall, and the second side wall comprises a first lower side wall portion and a second upper side wall portion hingedly connected to the first lower side wall portion and wherein the first notch and the second notch of the second side wall are positioned on an interior of the first lower side wall portion of the second side wall.

22. The folding container of claim 21 further comprising:

a rectangular rim having a first side and an opposing second side, a first end and an opposing second end, the first side of the rim connected to the second upper side wall portion of the first side wall, and the second side of the rim connected to the second upper side wall portion of the second side wall.

23. The folding container of claim 22 further comprising:

a first end wall rotationally connected to the first end of the rim, the first end wall including a lip on a lower portion of the first end wall wherein the lip is captured by the first and second interlock tabs when the container is in an unfolded configuration; and, a second end wall rotationally connected to the second end of the rim, the second end wall including a lip on a lower portion of the second end wall wherein the lip is captured by the third and fourth interlock tabs when the container is in an unfolded configuration.

* * * * *